US010573215B2

(12) United States Patent
Zheng et al.

(10) Patent No.: US 10,573,215 B2
(45) Date of Patent: Feb. 25, 2020

(54) METHOD AND DEVICE FOR SIMPLIFYING TCON SIGNAL PROCESSING

(71) Applicant: Wuhan China Star Optoelectronics Technology Co., Ltd., Wuhan, Hubei (CN)

(72) Inventors: Zike Zheng, Hubei (CN); Lulu Xie, Hubei (CN); Chunpeng Guo, Hubei (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 0 days.

(21) Appl. No.: 16/152,871

(22) Filed: Oct. 5, 2018

(65) Prior Publication Data

US 2019/0304351 A1 Oct. 3, 2019

Related U.S. Application Data

(63) Continuation of application No. PCT/CN2018/096593, filed on Jul. 23, 2018.

(30) Foreign Application Priority Data

Mar. 27, 2018 (CN) ..... 2018 1 0259706

(51) Int. Cl.
*G09G 3/20* (2006.01)

(52) U.S. Cl.
CPC ..... *G09G 3/20* (2013.01); *G09G 2310/08* (2013.01); *G09G 2370/14* (2013.01)

(58) Field of Classification Search
CPC ... G09G 3/20; G09G 2370/14; G09G 2310/08
See application file for complete search history.

(56) References Cited

U.S. PATENT DOCUMENTS

2003/0085906 A1* 5/2003 Elliott ..... G09G 3/20 345/613
2012/0242628 A1* 9/2012 Yuan ..... G09G 3/20 345/204

FOREIGN PATENT DOCUMENTS

CN 102262849 A 11/2011

* cited by examiner

*Primary Examiner* — Andrew Sasinowski
(74) *Attorney, Agent, or Firm* — Leong C. Lei

(57) ABSTRACT

The present invention teaches a signal processing method and a signal processing device for simplifying TCON. The method includes the steps of: receiving a low voltage differential signaling (LVDS) signal and decoding the LVDS signal to obtain TCON signal width, period, and look-up table. The LVDS signal includes a clock signal and five data signals. TCON parameters are encoded in the empty differential pairs in the first bits of the last two data signals within continuous cycles. The TCON parameters include TCON signal width, period, and look-up table. By the present invention, TCON obtains TCON parameters from LVDS in a same sequence as they are stored in prior art's EEPROM. TCON resource is as such saved, and an external EEPROM may be omitted for lower production cost, under identical operation condition.

10 Claims, 4 Drawing Sheets

METHOD AND DEVICE FOR SIMPLIFYING TCON SIGNAL PROCESSING

CROSS-REFERENCE TO RELATED APPLICATIONS

This application is a continuing application of PCT Patent Application No. PCT/CN2018/096593, filed on Jul. 23, 2018, which claims priority to Chinese Patent Application No. 201810259706.8, filed on Mar. 27, 2018, both of which are hereby incorporated herein by reference in their entireties.

FIELD OF THE INVENTION

The present invention is generally related to the field of display technology, and more particularly to Timer Control Register (TCON) signal processing method and device.

BACKGROUND OF THE INVENTION

FIG. 1 shows the structure of a conventional TCON. An electrically erasable programmable read only memory (EEPROM) is configured outside the TCON for storing various parameters for the TCON such as signal width, signal period, and look-up table. TCON accesses the content of the EEPROM through an I2C controller. However, the I2C controller takes up a certain resource from the TCON. The externally configured EEPROM also makes a higher hardware cost.

SUMMARY OF THE INVENTION

To resolve the above technical issues, the present invention teaches a method and a device to simplify TCON signal processing.

The present invention teaches a signal processing method for simplifying TCON, comprising the steps:

receiving a low voltage differential signaling (LVDS) signal, where the LVDS signal comprises a clock signal and five data signals, a plurality of TCON parameters are encoded in the empty differential pairs in the first bits of the last two data signals within a plurality of continuous cycles, and the TCON parameters comprise TCON signal width, period, and look-up table; and decoding the LVDS signal to obtain TCON signal width, period, and look-up table.

The clock signal and the five data signals have synchronous cycles of identical length.

Each data signal has 7 bits within each cycle.

The signal processing method, further comprises the steps of, before decoding the LVDS signal, comparing a preset number of leading bits of the LVDS signal against a preset read-attribute parameter; and reading the LVDS signal when the preset number of leading bits of the LVDS signal is identical to the preset read-attribute parameter.

For each TCON parameter carried by the LVDS signal, its data bits are arranged sequentially and alternately in the first bits of the fourth and fifth data signals in the continuous cycles.

The present invention also teaches a signal processing device for simplifying TCON, which comprises a reception module for receiving a LVDS signal, where the LVDS signal comprises a clock signal and five data signals, a plurality of TCON parameters are encoded in the empty differential pairs in the first bits of the last two data signals within a plurality of continuous cycles, and the TCON parameters comprise TCON signal width, period, and look-up table; and a decoding module for decoding the LVDS signal and obtaining the TCON signal width, period, and look-up table.

The clock signal and the five data signals have synchronous cycles of identical length.

Each data signal has 7 bits within each cycle.

The signal processing device further comprises a comparison module for comparing a preset number of leading bits of the LVDS signal against a preset read-attribute parameter; and an accessing module for reading the LVDS signal when the comparison module has determined that the preset number of leading bits of the LVDS signal is identical to the preset read-attribute parameter.

The five data signals are first, second, third, fourth, and fifth data signals. For each TCON parameter carried by the LVDS signal, its data bits are arranged sequentially and alternately in the first bits of the fourth and fifth data signals in continuous cycles, starting from bit 0 in the first bit of a first cycle of the fourth data signal.

The present invention has the following advantages.

TCON obtains TCON parameters, including signal width, period, and look-up table, through LVDS. TCON resource is as such saved, and an external EEPROM may be omitted for lower production cost, under identical operation condition.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

The core concept of the present embodiment is to carry TCON signal parameters such as signal width, period, look-up table, etc., in the low voltage differential signaling (LVDS), thereby saving system resource and hardware cost.

In the following, embodiments of the present invention are described along with the accompanied drawings.

Figure 1:
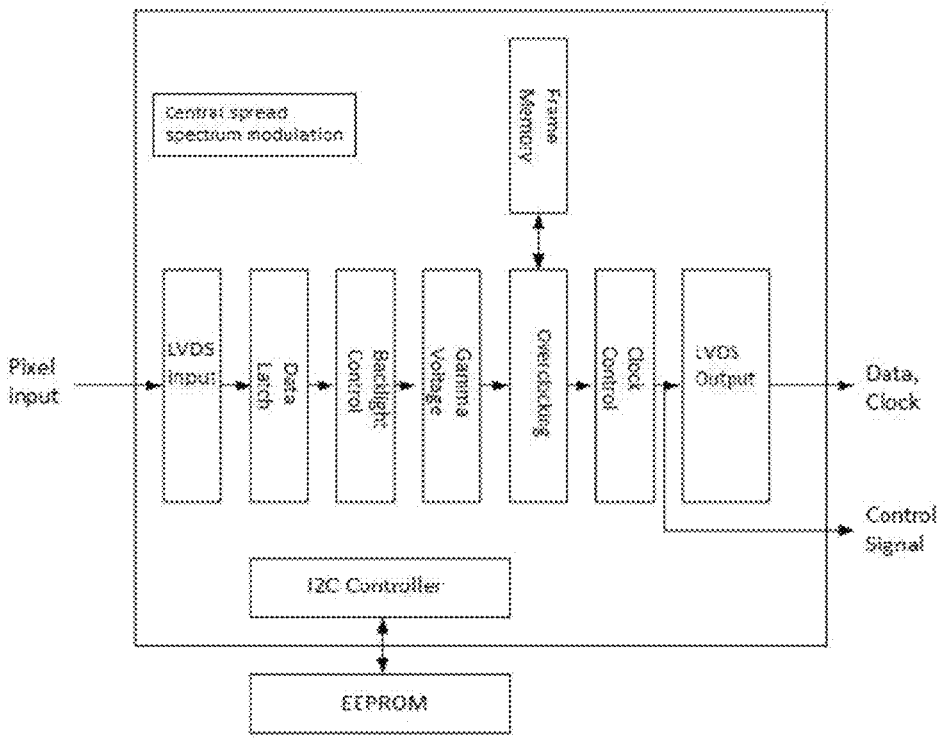
FIG. 1 (Prior art)
FIG. 1 is a structural schematic diagram showing a conventional TCON.
Figure 2:
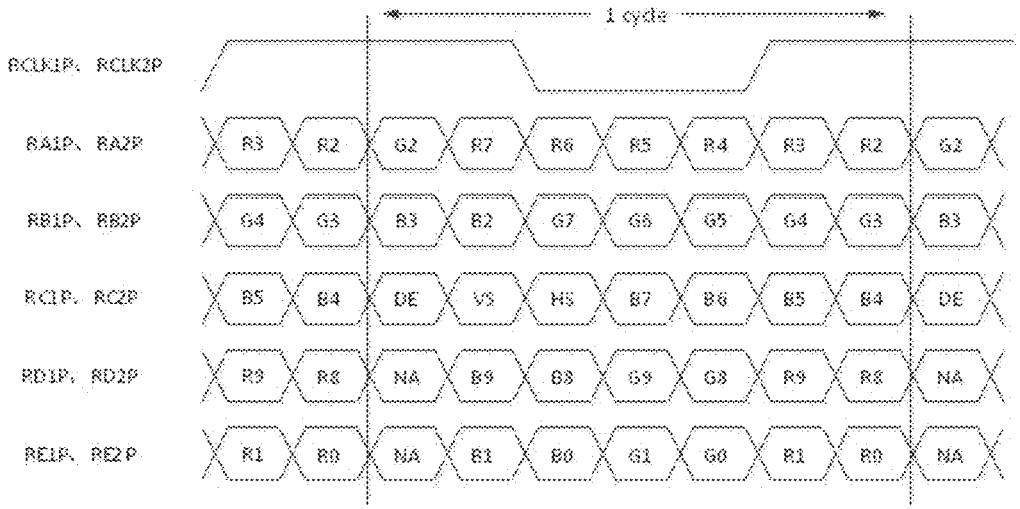
FIG. 2 is a timing diagram showing a LVDS signal according to an embodiment of the present invention.

As shown in FIG. 2, a LVDS signal of the present embodiment includes a clock signal and five data signals.

The clock signal is for data synchronization. The five data signals are referred to as the first, second, third, fourth, and fifth data signals. The clock signal and the five data signals have synchronous cycles of identical length. In the present embodiment, within each cycle, each data signal has 7 bits.

The terms "first" to "fifth" are not only used to referred to the data signals, they also indicate an order of the data signals.

Under existing technique, the first bits of the fourth and fifth data signals within each cycle are empty differential pairs (NA) and contain no data. TCON parameters then may be encoded and carried in these un-used bits of the last two data signals. The TCON parameters include TCON signal width, period, and look-up table.

Figure 3:
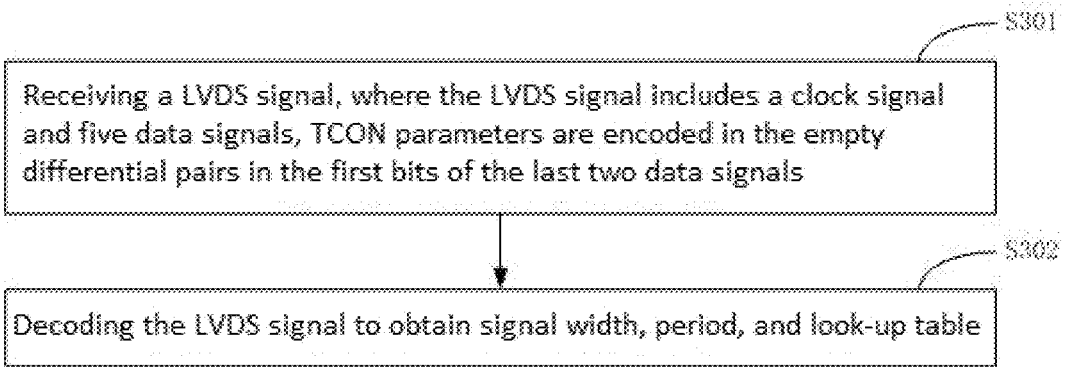
FIG. 3 is a flow diagram showing a signal processing method for simplifying TCON according to an embodiment of the present invention.

As shown in FIG. 3, a signal processing method according to an embodiment of the present invention includes the following steps.

Step S301: receiving a LVDS signal, where the LVDS signal includes a clock signal and five data signals and, within each cycle, TCON parameters are encoded in the empty differential pairs in the first bits of the last two data signals.

Specifically, the LVDS signal is received and decoded by TCON's LVDS RX module. In the present embodiment, the decoded signal is that originally stored in and to be retrieved from the EEPROM. Therefore, in the present embodiment, there is no point to keep the EEPROM as its content is encoded in and may be obtained from the LVDS signal.

The TCON parameters encoded in the LVDS signal are in a same sequence as they are stored in and retrieved from the EEPROM. Therefore, there is no need to modify TCON's original processing logic and sequence in order to handle the modified LVDS signal.

Step S302: decoding the LVDS signal to obtain TCON parameters including TCON signal width, period, and look-up table.

As the TCON parameters are encoded in the LVDS signal in the same sequence as they are stored in and retrieved from the EEPROM. The LVDS RX module may obtain TCON signal width, period, and look-up table without modification.

In order to correctly decode the received TCON parameters, the first 10 bits in the LVDS signal is for verification. A read-attribute parameter is preset as "1011101010." If the leading 10 bits from the LVDS signal is identical to the preset read-attribute parameter, it is determined that TCON parameters will correctly follows, and may be read as indicated by the read-attribute parameter. The read-attribute parameter means that, once this parameter is received, a read operation may be conducted to the subsequent signal. Similarly, there also may be write-attribute parameter agreed upon by the TCON and LVDS. Once the write-attribute parameter is received and verified, a write operation may be conducted to the subsequent signal. Therefore, before decoding the LVDS signal, a preset number of leading bits of the LVDS signal is compared against the preset read-attribute parameter. If the two are identical, it is assumed that TCON parameters will subsequently and correctly follows and therefore may be read.

Figure 4:
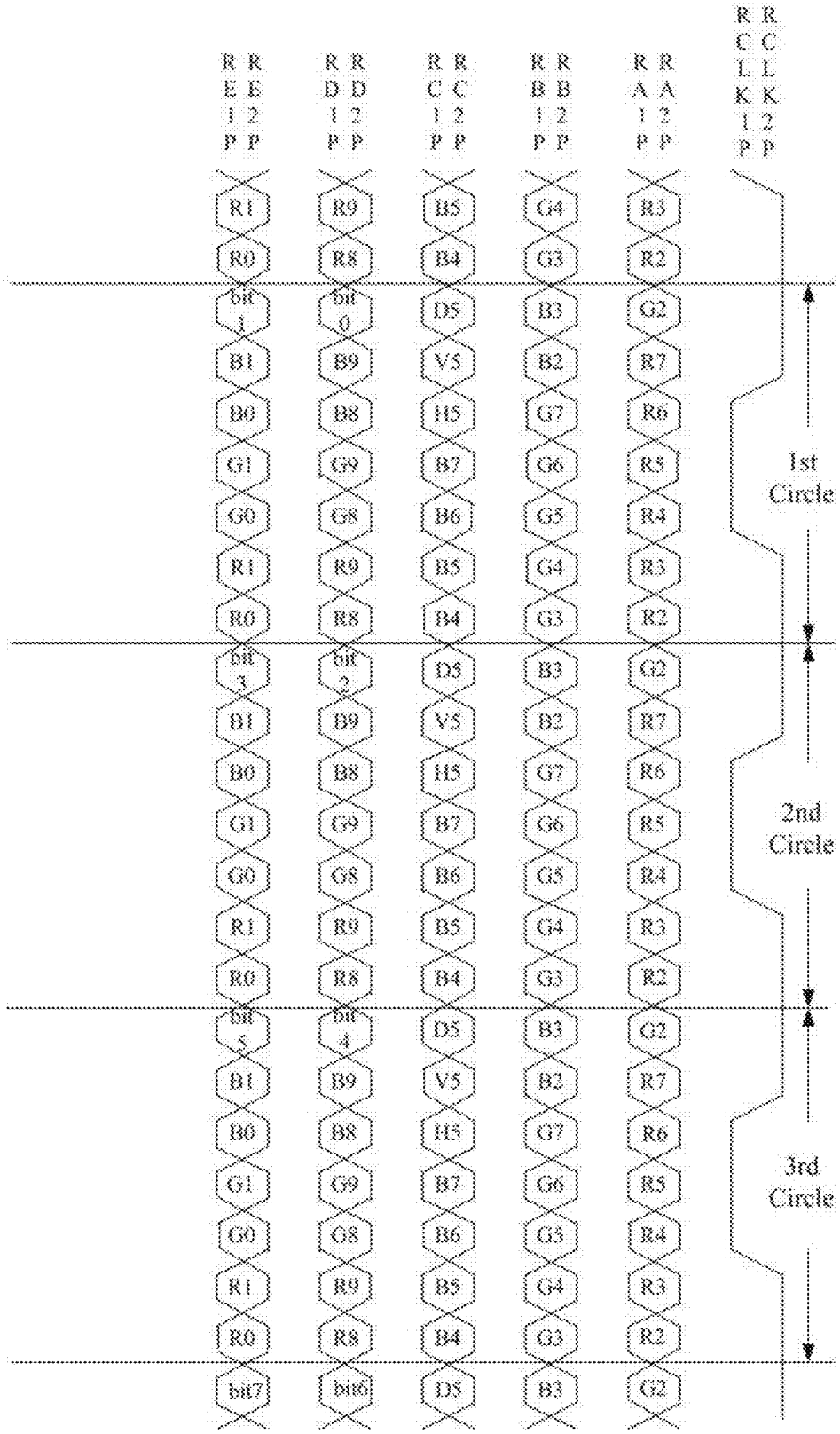
FIG. 4 demonstrates how a TCON parameter is carried in a LVDS signal.

FIG. 4 demonstrates how a TCON parameter is carried in the LVDS signal. In this example, it is assumed that it is the TCON signal width that is carried by the LVDS signal.

The signal width data has 10 bits, namely, bit 0 to bit 9. These 10 bits are arranged in the following order: bit 0 in the fourth data signal's first bit in a first cycle, bit 1 in the fifth data signal's first bit in the first cycle, bit 2 in the fourth data signal's first bit in a subsequent second cycle, bit 3 in the fifth data signal's first bit in the second cycle, and so on for subsequent third, fourth, and fifth cycles. For brevity's sake, FIG. 4 only shows complete first, second, and third cycles carrying bit 0 to bit 5, and partial fourth cycle carrying bit 6 and bit 7.

Figure 5:
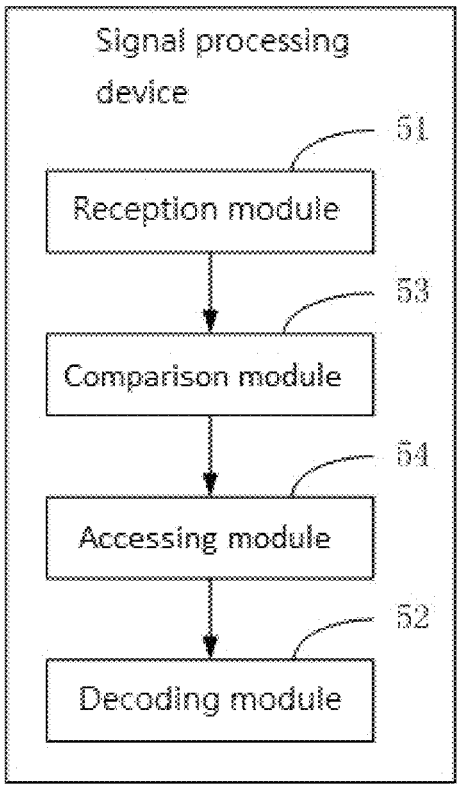
FIG. 5 is a functional block diagram showing a signal processing device for simplifying TCON according to an embodiment of the present invention.

As shown in FIG. 5, the present invention also teaches a signal processing device for simplifying TCON, which includes the following components.

A reception module 51 is for receiving a LVDS signal, where the LVDS signal includes a clock signal and five data signals and, within each cycle, TCON parameters are encoded in the empty differential pairs in the first bits of the last two data signals. The TCON parameters include TCON signal width, period, and look-up table.

A decoding module 52 is for decoding the LVDS signal and obtaining the TCON signal width, period, and look-up table.

The clock signal and the five data signals have synchronous cycles of identical length and, within each cycle, each data signal has 7 bits.

The signal processing device further includes the following components.

A comparison module 53 is for comparing a preset number of leading bits of the LVDS signal against a preset read-attribute parameter.

An accessing module 54 is for reading the LVDS signal carrying the TCON parameters when the comparison module 53 has determined that the preset number of leading bits of the LVDS signal is identical to the preset read-attribute parameter.

The five data signals are first, second, third, fourth, and fifth data signals. For each TCON parameter carried by the LVDS signal, its data bits are arranged sequentially and alternately in the first bits of the fourth and fifth data signals in continuous cycles, starting from bit 0 in the first bit of a first cycle of the fourth data signal.

The present invention has the following advantages.

TCON obtains TCON parameters, including signal width, period, and look-up table, through LVDS. TCON resource is as such saved, and an external EEPROM may be omitted for lower production cost, under identical operation condition.

It should be noted that, in the present specification, terms such as "first," "second," etc. are for reference purpose only so as to distinguish one entity or operation from another entity or operation. They do not specify or imply that there is some preference or order among these entities or operations, unless specifically indicated. Additionally, "include," "comprise," or other similar terms do not exclude any element not explicitly specified. In other words, an object "includes" not only those elements explicitly listed, but also those elements not explicitly specified and those elements inherent in the object. Without further limitation, phrases like "an object includes one . . . " do not exclude that there may be other identical element.

Above are embodiments of the present invention, which does not limit the scope of the present invention. Any equivalent amendments within the spirit and principles of the embodiment described above should be covered by the protected scope of the invention.

What is claimed is:

1. A signal processing method for simplifying Timer Control Register (TCON), comprising receiving a low voltage differential signaling (LVDS) signal, where the LVDS signal comprises a clock signal and five data signals, a plurality of TCON parameters are encoded in the empty differential pairs in the first bits of the last two data signals within a plurality of continuous cycles, and the TCON parameters comprise TCON signal width, period, and look-up table; and decoding the LVDS signal to obtain TCON signal width, period, and look-up table.

2. The signal processing method according to claim 1, wherein the clock signal and the data signals have synchronous cycles of identical length.

3. The signal processing method according to claim 2, wherein each data signal has 7 bits within each cycle.

4. The signal processing method according to claim 1, further comprising comparing a preset number of leading bits of the LVDS signal against a preset read-attribute parameter; and reading the LVDS signal when the preset number of leading bits of the LVDS signal is identical to the preset read-attribute parameter.

5. The signal processing method according to claim 1, wherein the five data signals are first, second, third, fourth, and fifth data signals; and, for each TCON parameter carried by the LVDS signal, its data bits are arranged sequentially and alternately in the first bits of the fourth and fifth data signals in the continuous cycles.

6. A signal processing device for simplifying Timer Controller Register (TCON), comprising a reception module for receiving a LVDS signal, where the LVDS signal comprises a clock signal and five data signals, a plurality of TCON parameters are encoded in the empty differential pairs in the first bits of the last two data signals within a plurality of continuous cycles, and the TCON parameters comprise TCON signal width, period, and look-up table; and a decoding module for decoding the LVDS signal and obtaining the TCON signal width, period, and look-up table.

7. The signal processing device according to claim 6, wherein the clock signal and the data signals have synchronous cycles of identical length.

8. The signal processing device according to claim 6, wherein each data signal has 7 bits within each cycle.

9. The signal processing device according to claim 6, further comprising a comparison module for comparing a preset number of leading bits of the LVDS signal against a preset read-attribute parameter; and an accessing module for reading the LVDS signal when the comparison module has determined that the preset number of leading bits of the LVDS signal is identical to the preset read-attribute parameter.

10. The signal processing device according to claim 6, wherein the five data signals are first, second, third, fourth, and fifth data signals; and, for each TCON parameter carried by the LVDS signal, its data bits are arranged sequentially and alternately in the first bits of the fourth and fifth data signals in the continuous cycles.

* * * * *